United States Patent [19]

Hug

[11] 4,278,456

[45] Jul. 14, 1981

[54] VACUUM CLEANER

[75] Inventor: Niklaus Hug, Romanshorn, Switzerland

[73] Assignee: Rommag P. Wörwag & Co., Romanshorn, Switzerland

[21] Appl. No.: 106,483

[22] Filed: Dec. 26, 1979

[30] Foreign Application Priority Data

Dec. 23, 1978 [DE] Fed. Rep. of Germany ..... 2856102

[51] Int. Cl.[3] ..... B01D 46/04

[52] U.S. Cl. ..... 55/429; 15/352; 55/472; 55/502

[58] Field of Search ..... 55/361, 366, 374–379, 55/428, 429, 472, 507, 509, 502; 15/327, 327 A–327 F, 353, 352

[56] References Cited

U.S. PATENT DOCUMENTS 2,865,465 12/1958 Lachowicz ..... 55/373
3,802,166 4/1974 Mattsson ..... 55/372

FOREIGN PATENT DOCUMENTS 772842 12/1967 Canada ..... 15/327 E
2719397 11/1978 Fed. Rep. of Germany ..... 15/327 R
1158118 7/1969 United Kingdom ..... 15/327 E

*Primary Examiner*—Bernard Nozick
*Attorney, Agent, or Firm*—Becker & Becker, Inc.

[57] ABSTRACT

A vacuum cleaner includes a receiving chamber and a removable dust collecting container. The dust collecting container has a guide groove on that outer surface facing the inlet flow connection of the vacuum cleaner, and this guide groove is adapted or matched to the discharge opening of the inlet flow connection. The guide groove extends from the bottom surface of the dust collecting container vertically upwardly as far as to the inlet flow opening of the dust collecting container. The dust collecting container has short inlet ribs arranged in an upper region upon that outer surface located across from the inlet flow opening and starting ribs in the transition between the bottom surface of the receiving chamber inlet rib containing wall. A soft elastic seal is pressed against the sealing surface of the dust collecting container in a region of the inlet flow opening, and the sealing surface surrounds the inlet flow connection.

7 Claims, 3 Drawing Figures

VACUUM CLEANER

The present invention relates to a vacuum cleaner for professional and household purposes with a removable dust collecting container. To establish an air-tight and dust-tight connection between the inlet flow opening of the dust collecting container and the mouth of an inlet flow connection or connecting piece arranged in the vacuum cleaner housing for the dust containing air, a seal is provided.

BACKGROUND OF THE INVENTION

The production of an air-tight and dust-tight connection between the inlet flow opening of the dust collecting container and the mouth of an inlet flow connection, arranged in the vacuum cleaner housing for the dust-containing air, previously involved considerable complexity. Accordingly, for example, after insertion of the dust collecting container, the dust collecting container is pressed with a special device against the mouth of the inlet flow connection and a seal arranged there.

FIELD OF THE INVENTION

It is therefore an object of the present invention to embody a vacuum cleaner in such a manner that a quick and exact installation of the dust collecting container in the apparatus housing is possible with the least possible structural complexity and expense, while simultaneously attaining a seal, between the inlet flow connection and the dust collecting container, which is sufficient to meet requirements. Reference is made to copending application Ser. No. 106,481 filed Dec. 26, 1979.

This object, and other objects and advantages of the present invention, will appear more clearly from the following sepcification.

SUMMARY OF THE INVENTION

The vacuum cleaner of the present invention is characterized primarily in that, for an insertion or installation of the dust-collecting container in a receiving chamber provided for this purpose in the apparatus housing, as well as for producing a sealing fixation, having an adapted configuration, between the inlet flow opening and the mouth of the inlet flow connection, there are provided suitable positive guide means. Expedient configurations and embodiments of the inventive concept can additionally include the following features.

The dust collecting container may have a guide groove on that outer surface facing the inlet flow connection, and this guide groove is matched or adapted to the mouth of the inlet flow connection projecting into the apparatus housing. The guide groove extends vertically from the bottom surface of the dust collecting container upwardly as far as to the inlet flow opening. The dust collecting container, on that outer surface located across from the inlet flow opening, in the upper region, may have one or more short inlet ribs. The inlet ribs, during installation or insertion of the dust collecting container, as well as in the installed condition, engage against that wall located across from the inlet flow opening, preferably engage against a separating wall extending transverse to the longitudinal axis of the apparatus housing. One or more inlet or starting ribs are arranged in a gusset or wedge (plate) between the bottom surface of the receiving chamber and the separating wall. The inlet or starting ribs have an inclined starting surface. The dust collecting container has a sealing surface which surrounds the inlet flow connection in the region of the inlet flow opening. The mouth of the inlet flow connection has a soft-elastic seal arranged therearound. The sealing surface of the dust collecting container engages, under pressure, against the seal. The inlet ribs and the starting ribs are arranged and dimensioned in such a way that the dust collecting container, in the last phase of its vertical or substantially vertical insertion movement, additionally carries out or follows a path of movement in a short horizontal or substantially horizontal path against the seal installed on the inlet flow connection.

The dust collecting container, during insertion, slides into the chamber provided for this purpose, with the inventively embodied guide groove as a positive guide at the mouth of the inlet flow connection, until the inlet flow opening covers the inlet flow connection. The ribs, as further positive guides, bring about for the dust collecting container, in the last phase of its vertical or substantially vertical installation movement, additionally a short, horizontal path of movement. An air-tight and dust-tight connection results with this embodiment between the inlet flow connection for the dust-air and the inlet flow opening of the dust collecting container, without utilization of an additional auxiliary means.

These and other objects and advantages of the present invention, will appear more clearly from the following specification in connection with the accompanying drawings, in which:

IN THE DRAWINGS

DETAILED DESCRIPTION

Figure 1:
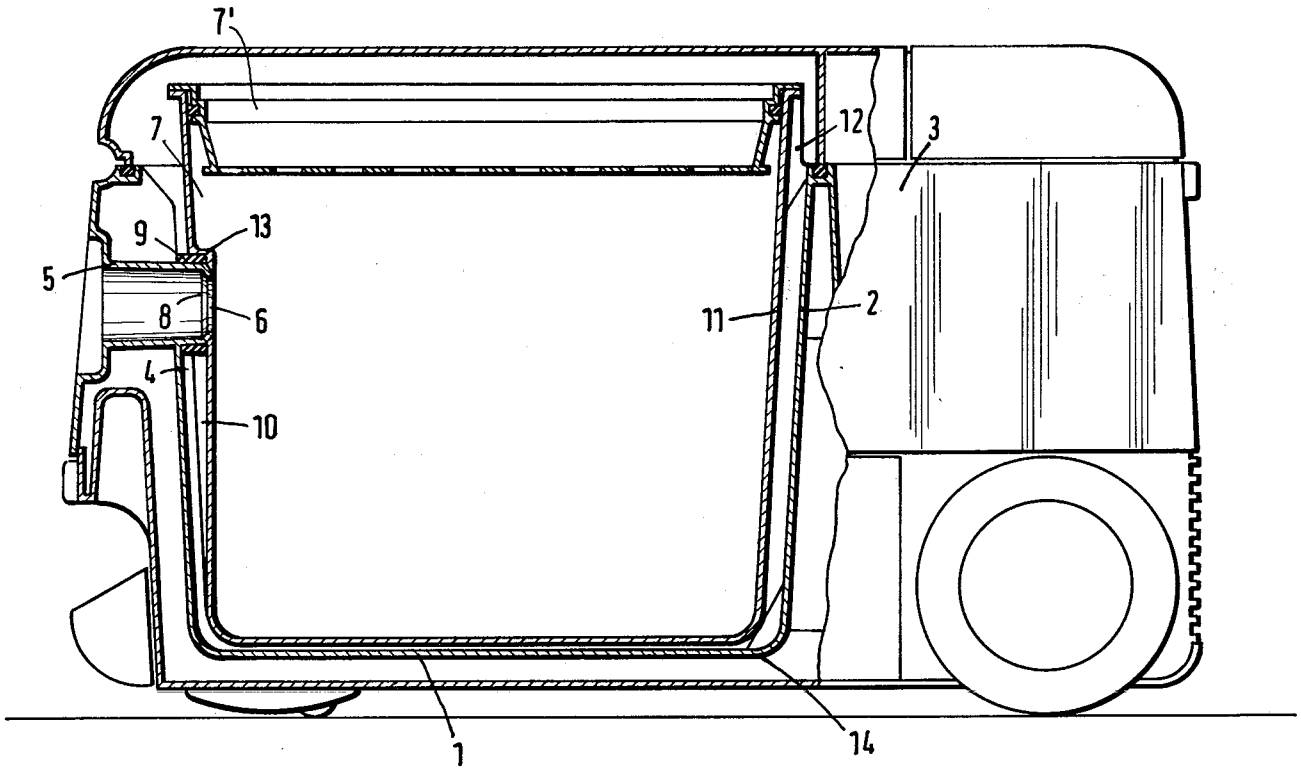
FIG. 1 illustrates a vacuum cleaner according to the present invention in partial longitudinal cross section and a partial view with a dust collecting container installed in the working position.
Figure 2:
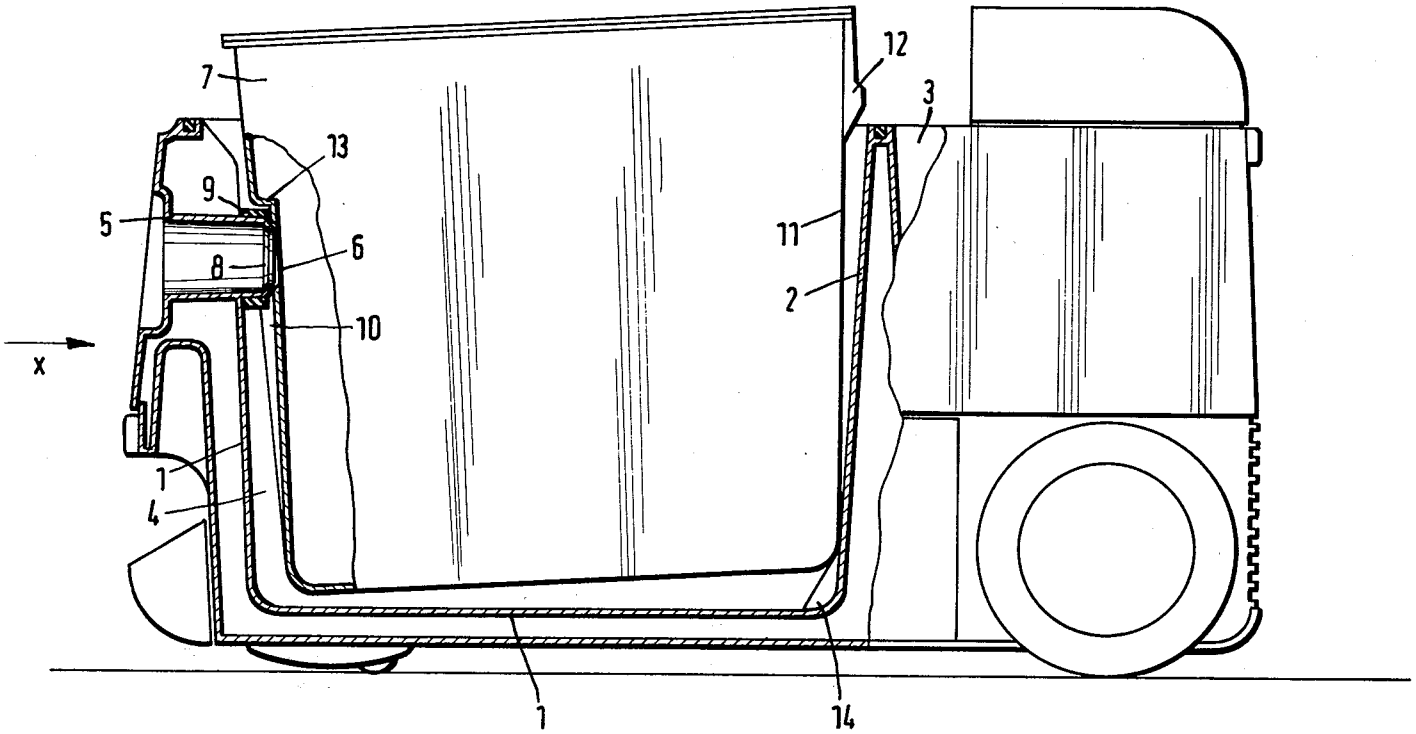
FIG. 2 illustrates a vacuum cleaner in a partial longitudinal cross section and a partial view with a dust collecting container shown in the last phase of the installation movement.
Figure 3:
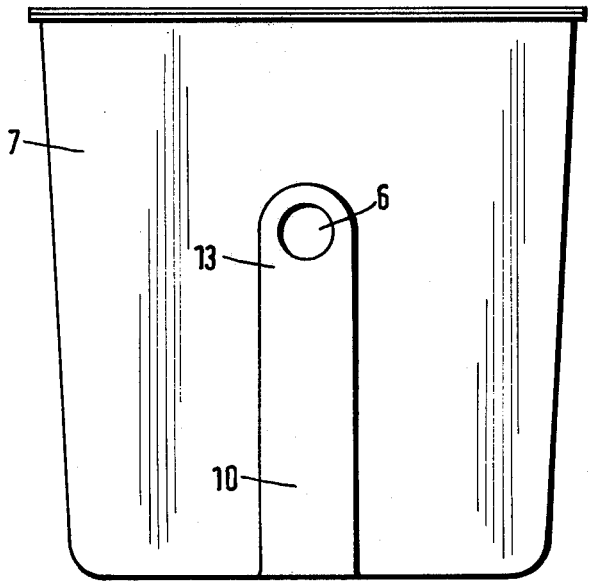
FIG. 3 is a view of the dust collecting container taken in the direction x according to FIG. 2.

Referring now to the drawings in detail, the pan-shaped apparatus housing 1 of the vacuum cleaner is subdivided by a separating wall 2 extending transverse to the longitudinal axis of the apparatus housing 1; the subdivision brought about by the separating wall 2 includes a larger chamber 4, which receives the dust collecting container 7 provided with a filter 7', and a smaller motor chamber 3, which receives the motor blower. The larger receiving chamber 4 adjoins the suction side end face.

That wall of the dust collecting container 7 directed toward the inlet flow connection 5 has an inlet flow opening 6 which opens out or discharges into the interior of the dust collecting container 7 and is located in alignment with or coinciding with the discharge of the inlet flow connection 5 in the installed condition of the dust collecting container 7 in the apparatus housing 1. Dust-containing air is guided into the dust collecting container 7 by a non-illustrated suction tool or device by way of a non-illustrated suction conduit, for instance a suction hose, through the inlet flow opening 6 by way of the inlet flow connection 5.

The dust collecting container 7 is maintained having its size or dimension in such a manner that the dust collecting container 7 can be installed in the receiving chamber 4 with play on all sides. For the purpose of then attaining an air-tight and dust-tight connection between the inlet flow connection 5 of the apparatus housing 1 and the inlet flow opening 6 of the dust collecting container 7, one or more short inlet or starting ribs 12 are arranged in an upper region of the outer surface 11 of the dust collecting container 7 at a location across from the inlet flow opening 6, and one or more starting or contact ribs 14 are arranged in the gusset (plate) between the bottom surface of the receiving chamber 4 and the wall located across from the inlet flow opening 6, such being represented for example as a separating wall 2 extending transverse to the longitudinal axis of the apparatus housing 1. The inlet ribs 12 and the starting ribs 14 are so installed and have such a size or dimension that upon insertion or installation of the dust collecting container 7 in the receiving chamber 4, the ribs bring the container into alignment or covering relationship with the inlet flow opening 6 thereof coinciding with the discharge opening 8 of the inlet flow connection 5, consequently pressing the dust collecting container 7, in the last phase of its vertical or substantially vertical installation movement, against the soft-elastic seal 9 arranged on the inlet flow connection 5, with such installation movement occurring by running the ribs 12 against the wall 2 additionally bringing about a short horizontal or substantially horizontal path. This movement is supported by impinging upon the starting ribs 14, which have an inclined starting surface. Under these circumstances, the sealing surface 13, which encircles the inlet flow connection 5 and is located on the dust collecting container 7 in the region of the inlet flow opening 6, engages under pressure against the soft-elastic seal 9 arranged around the mouth or discharge opening 8 of the inlet flow connection 5.

The slightly conically embodied dust collecting container 7 has a guide groove 10 on that outer surface directed toward the inlet flow connection 5. This guide groove 10 is matched or adapted to the mouth or opening 8, of the inlet flow connection 5, which projects into the apparatus housing 1. The guide groove 10 expediently extends from the bottom surface of the dust collecting container 7 vertically upward as far as to the inlet flow opening 6. The dust collecting container 7 slides with the guide groove 10 against the mouth or opening 8 of the inlet flow connection 5 as far as to covering relationship or alignment which coincides the inlet flow opening 6 of the dust collecting container 7 with the inlet flow connection 5.

The present invention is, of course, in no way restricted to the specific disclosure of the specification and drawings, but also encompasses any modifications within the scope of the appended claims.

What I claim is:

1. A vacuum cleaner for professional, commercial, and household use, comprising:

a housing having a longitudinal axis and interior provided with inlet means including an opening that projects into and communicates with the interior of said housing for admitting dust-laden air thereto;

a removable dust collecting container including a filter and having an upper edge region and a bottom surface as well as an outer surface facing the inlet means, said container being inserted and received in said housing interior and being provided with an inlet flow opening communicating with said inlet means for receiving dust-laden air;

a seal arranged between said inlet flow opening of said container and said opening of said inlet means for establishing an airtight and dust-tight connection therebeteen;

rib means on said housing for facilitating insertion of said dust collecting container in said housing interior, and for producing, along with said seal, a sealing fixation located between said inlet flow opening of said container and said opening of said inlet means;

said dust collecting container on that outer surface thereof which faces said inlet means, being provided with a guide groove which is arranged to engage said opening of said inlet means with nominal play; and at least one inlet rib provided with said dust collecting container on the outer surface thereof located across from said inlet flow opening, said rib engaging against said housing of the vacuum cleaner and having an inclined mounting surface and an engagement surface adjoining the mounting surface with which the inserted dust collecting container engages against said housing of the vacuum cleaner.

2. A vacuum cleaner according to claim 1, in which said guide groove is adapted to extend vertically upwardly from the bottom surface of said container to said inlet flow opening.

3. A vacuum cleaner according to claim 2, in which said at least one inlet rib is arranged on that outer surface of said dust collecting container in a location opposite said inlet flow opening particularly in the upper edge region of the outer surface on the dust collecting container.

4. A vacuum cleaner according to claim 3, in which said housing includes an interior wall located across from said opening of said inlet means, said at least one inlet rib, during insertion of said container into said housing interior, and in the installed state, being adapted to engage said wall, said wall subdividing said housing interior and extending transverse to the longitudinal axis of said housing.

5. A vacuum cleaner according to claim 4, in which at least one further rib is arranged in the transition between the bottom of said housing interior and said wall, said at least one further rib having an inclined surface in a location toward the dust collecting container.

6. A vacuum cleaner according to claim 5, in which said dust collecting container has a sealing surface located in the region of sid inlet flow opening and adapted to surround said opening of said inlet means, said seal being a soft-elastic seal arranged around said opening of said inlet means.

7. A vacuum cleaner according to claim 6, in which said dust collecting container is adapted to be inserted at least substantially vertically into said housing interior, and in which said at least one inlet rib and said at least one further rib are arranged and dimensioned in such a way that during the last phase of insertion of said dust collecting container, the latter is adapted to undergo an at least substantially horizontal movement against said seal which engages said sealing surface under pressure due to said horizontal movement.

* * * * *